United States Patent [19]

Takamatsu et al.

[11] 3,973,300

[45] Aug. 10, 1976

[54] FASTENER SLIDER

[76] Inventors: Ikuo Takamatsu, Uozu, Japan; Yoshida Kogyo Kabushiki Kaisha, 03, Japan

[22] Filed: Feb. 4, 1975

[21] Appl. No.: 546,878

[30] Foreign Application Priority Data

Feb. 8, 1974 Japan ..... 49-16539[U]

[52] U.S. Cl. ..... 24/205.15 R; 24/205.1 R

[51] Int. Cl.[2] ..... A44B 19/26

[58] Field of Search ..... 24/205.15 R, 205.15 E, 24/205.12, 205.1 R, 205.1 C

[56] References Cited

UNITED STATES PATENTS

| | | | |
|---|---|---|---|
| 1,817,839 | 8/1931 | Pouy | 24/205.12 |
| 2,296,831 | 9/1942 | Bloxsom | 24/205.15 R |
| 2,325,709 | 8/1943 | Samstegman | 24/205.15 R |
| 2,842,824 | 7/1958 | Morin | 24/205.15 R |
| 3,122,807 | 3/1964 | Ausnit | 24/205.15 R |
| 3,170,208 | 2/1965 | Morin | 24/205.15 R |
| 3,334,387 | 8/1967 | Gauthier | 24/205.15 R |
| 3,431,605 | 3/1969 | Hasslinger | 24/205.12 |
| 3,522,639 | 8/1970 | Frohlich | 24/205.15 R |

*Primary Examiner*—Bernard A. Gelak

*Attorney, Agent, or Firm*—Bucknam and Archer

[57] ABSTRACT

The bottom wing of the slider body has a pair of lateral extensions which are angled toward the top wing. When the slide fastener including this slider is attached to an article such that the opening therein is bounded by one or two pairs of edges disposed in opposed or abutting relationship, the lateral extensions from the bottom wing serve as guide members to raise the rear edge portions of the respective stringer tapes out of the plane of their element-carrying front edges. Since the article edges are thus held over, and under, the slider body, they are prevented from becoming caught between the top and bottom wings of the slider body during slider movement along the fastener elements.

2 Claims, 4 Drawing Figures

FASTENER SLIDER

BACKGROUND OF THE INVENTION

This invention relates generally to slide fasteners, and more specifically to the improved construction of a fastener slider including means for preventing the accidental intrusion into the slider body of one or two pairs of opposed or abutting edges bounding an opening in a garment or like article to which the slide fastener is attached.

As is well known, the opposed or abutting article edges bounding the opening to which the slide fastener is applied, which edges may exist on one or both sides of the fastener, are easy to become caught between the top and bottom wings of the slider body as the slider is moved along the rows of interlocking fastener elements or scoops. In an attempt to overcome this inconvenience, there have been proposed a slider construction in which both top and bottom wings of the slider body have lateral expansions of considerable extent, and another in which horizontally extending guide members are formed on both top and bottom wings.

According to these known slider constructions, the opposed or abutting article edges are prevented from intruding into the slider body by the lateral expansions or guide members on the slider body that are disposed between the article edges and the stringer tapes. Thus, in applications where two pairs of such opposed or abutting article edges are formed on both sides of the slide fastener, it is of necessity that the slider body be equipped with the lateral expansions or guide members for the respective pairs of article edges.

Another disadvantage of the prior art slider constructions is that the lateral expansions or guide members on the slider body must be so extended in the transverse direction of the slide fastener as to terminate close to the points where the stringer tapes are stitched or otherwise affixed to the article. The sliders of such construction are of course inconveniently bulky and aesthetically unappealing.

SUMMARY OF THE INVENTION

In view of the listed disadvantages of the prior art, it is an object of this invention to provide a fastener slider with improved means for definitely preventing the intrusion into the slider body of the opposed or abutting edges of an article during the movement of the slider on a pair of fastener stringers attached thereto to openably close an opening bounded by such edges.

Another object of the invention is to provide a fastener slider of the above described character which is equally effective in applications where the desired opening is bounded by one pair of opposed or abutting edges and in other applications where the opening is bounded by two pairs of such edges existing on the opposite sides of the slide fastener.

A further object of the invention is to provide a fastener slider of the character described which is highly compact in construction and which is favorable from both utilitarian and aesthetic points of view.

With these objects in view and the other objects hereinafter set forth, this invention provides, in a fastener slider of the type having a body broadly comprising a top wing and a bottom wing which are so interconnected as to define a generally Y-shaped guide channel through the slider body, that improvement which includes a pair of guide members formed respectively by lateral extensions from the bottom wing only of the slider body, the lateral extensions being angled toward the top wing.

When the slide fastener including this slider is attached to an article in which the opening is bounded, for example, by two pairs of opposed or abutting edges disposed on the opposite sides of the fastener, the rear edge portions of the stringer tapes are raised by the upwardly angled guide members out of the plane of their front edge portions carrying respective longitudinal rows of interlocking fastener elements. One pair of article edges can thus be held over the top wing of the slider body, and the other pair under the bottom wing, during movement of the slider along the fastener elements. Accordingly there is substantially no possibility of either pair of article edges becoming caught between the top and bottom wings of the slider body.

It is noteworthy that the guide members need not be of any inconveniently large dimensions to fully attain the purposes for which they are intended. Moreover, since the guide members are formed only on the bottom wing of the slider body, this invention realizes substantial economy in the material used for the manufacture of the fastener sliders of this type.

The features which are believed to be novel and characteristic of this invention are set forth in particular in the claims appended hereto. The invention itself, however, both as to its construction and functions, together with the further objects and advantages thereof, will become more fully apparent as the description proceeds, with reference had to the accompanying drawings showing some specific adaptations of the invention and in which like reference characters refer to like parts throughout the several views.

DESCRIPTION OF THE PREFERRED EMBODIMENTS

Figure 1:
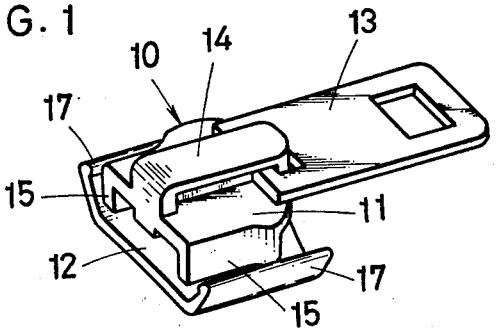
FIG. 1 is a perspective view of a fastener slider constructed in accordance with the novel concepts of this invention.

The fastener slider illustrated in FIG. 1 by way of a preferred embodiment of this invention is specifically adapted for use with fastener stringers of the type in which a row of fastener elements or scoops are arranged on one side only of each stringer tape, as will be later described with reference to FIGS. 2 and 3. The illustrated fastener slider includes a body 10 composed broadly of a top wing 11 and a bottom wing 12. A pull tab 13 is pivotally and slidably connected to the slider body 10 via a lug 14 formed on its top wing 11.

Although not shown in the drawings, it will be understood that the top and bottom wings 11 and 12 are interconnected by the usual web or neck located centrally at the front end of the slider body 10 directed to the right in FIG. 1. The top wing 11 has a pair of downwardly directed side flanges 15 along its marginal edges. The top wing 11 with its side flanges 15, the bottom wing 12, and the unshown web cooperate to define a generally Y-shaped guide channel through the slider body 10 for the passage therethrough of the one-sided fastener elements 16, FIGS. 2 and 3, as the slider is moved therealong to open or close the slide fastener.

According to the novel concepts of this invention, the bottom wing only of the slider body 10 has a pair of lateral extensions which are angled upwardly, that is, toward the top wing 11, to provide guide members 17. The guide members 17 project outwardly of the side flanges 15 of the top wing 11, and the top edges of the guide members are disposed higher than the bottom edges of the side flanges.

Figure 2:
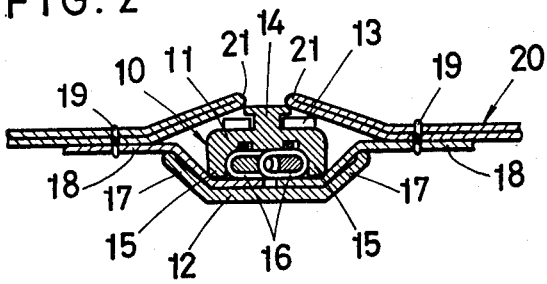
FIG. 2 is a cross sectional view showing a possible application of the fastener slider of FIG. 1, in which the slider is shown assembled with a pair of fastener stringers attached to an article the opening in which is bounded by a pair of opposed or abutting edges.

FIG. 2 illustrates a mode of use of the fastener slider of the foregoing configuration. The slider is shown assembled with a pair of fastener stringers including tapes 18 carrying the longitudinal rows of one-sided fastener elements 16 along their opposed front edges. The stringer tapes 18 are stitched at 19 to a garment or like article 20, in such a manner that the article edges 21 bounding the opening to be openably closed by the fastener are arranged in opposed or abutting relationship on the same side of the stringer tapes as the fastener elements 16.

It will be observed from a consideration of FIG. 2 that the rear edge portions of the stringer tapes 18, remote from the fastener elements 16, are raised out of the plane of their element-carrying front edges by the respective guide members 17. As a consequence, the article edges 21 are correspondingly raised so as to overlie the top wing 11 of the slider body 10. Hence there is practically no possibility of the article edges 21 becoming caught between the top and bottom wings 11 and 12 of the slider body 10 during movement of the slider along the fastener elements 16.

Figure 3:
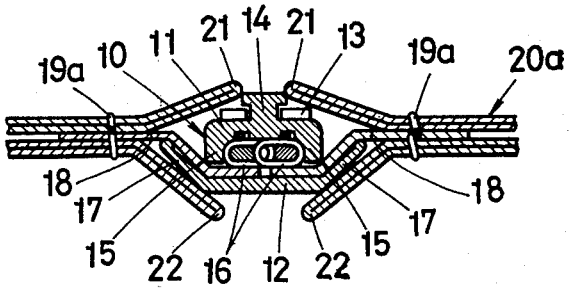
FIG. 3 is a similar view showing another possible application of the fastener slider of FIG. 1, in which the slider is shown assembled with a pair of fastener stringers attached to an article the opening in which is bounded by two pairs of opposed or abutting edges disposed on the opposite sides of the fastener.

In FIG. 3 the slider of FIG. 1 is shown assembled with the fastener stringers attached to an article 20*a* such that the desired opening therein is bounded by two pairs of opposed or abutting edges 21 and 22 disposed on the opposite sides of the fastener. The stringer tapes 18 are stitched at 19*a* to the article 20*a*. Other details of arrangement are exactly as above stated in connection with FIG. 2.

In this case the guide members 17 serve not merely to hold the pair of article edges 21 over the top wing 11 of the slider body 10 but to guide the other pair of article edges 22 downwardly under the bottom wing 12 of the slider body. The pairs of article edges 21 and 22 are thus both prevented from becoming caught between the top and bottom wings 11 and 12 of the slider body 10 during movement of the slider along the one-sided fastener elements 16.

Figure 4:
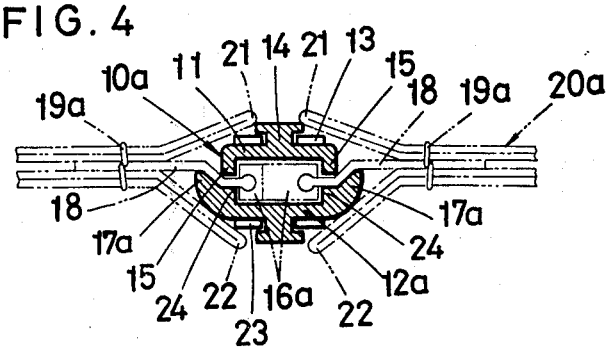
FIG. 4 is a cross sectional view of a modified example in which the inventive concepts are applied to a fastener slider having pull tabs on both of its top and bottom wings.

FIG. 4 illustrates another specific adaptation of the invention in which the inventive concepts are applied to a slider of the known type having not only the pull tab 13 connected to the top wing 11 of the slider body 10*a* as shown in FIG. 1 but another pull tab 23 connected in an identical manner to the bottom wing 12*a* as well. The top and bottom wings 11 and 12*a*, of course, are interconnected by the unshown web located centrally at the front end of the slider body 10*a*.

It will be noted that the guide members 17*a* of this slider are formed integral with, or double as, the upwardly directed side flanges 24 of the bottom wing 12*a*, respectively. Thus, the top wing 11 with its side flanges 15, the bottom wing 12*a* with its side flanges 24, and the unshown web cooperate to define a generally Y-shaped guide channel through the slider body 10*a* for the passage therethrough of the usual rows of interlocking fastener elements 16*a* affixed to the respective stringer tapes 18 by the clamping engagement of their opposed front edges.

The stringer tapes 18 are stitched at 19*a* to the article 20*a* such that the opening therein is bounded by the two pairs of opposed or abutting edges 21 and 22 disposed on the opposite sides of the slide fastener, as in the arrangement shown in FIG. 3. It will now be apparent that the guide members 17*a* serve to prevent the pairs of article edges 21 and 22 from becoming caught between the top and bottom wings 11 and 12*a* of the slider body 10*a* during movement of the slider along the fastener elements 16*a*.

Having thus described the improved fastener slider according to the invention, it is clear that the objects for which it was designed have been fully accomplished. However, while the invention has been shown and described herein in terms of only a few of its various possible adaptations, it is to be understood that the invention is open to a variety of modifications, and that changes may be made in the construction and arrangement of the various parts of the illustrated slide fasteners, without departing from the proper scope of fair meaning of the following claims.

What is claimed is:

1. In a slide fastener of the type having a pair of opposed stringer tapes and respective rows of fastener elements disposed along confronting edges of said stringer tapes, and a slider moveable along said rows of fastener elements to selectively open and close the slide fastener, said slider having a top wing, a bottom wing and means connecting said top and bottom wings to define a generally Y-shaped guide channel through said slider accommodating the passage of said rows of fastener elements, the improvement which comprises one of said wings having opposing lateral extensions defining guide members each directed at an inclination with respect to the other wing and engaging a corresponding stringer tape to hold said stringer tape in an offset configuration whereby the edge portion of the stringer tape remote from the row of fastener elements thereof is in a plane displaced from the row of fastener elements to prevent intrusion into the guide channel of other material attached to the stringer tape, the bottom wing having said guide members and including on said slider a pair of side flanges downwardly directed and formed along respective marginal edges of said top wing, and the bottom edges of said side flanges being disposed below the top edges of said guide members.

2. In a fastener slider of the type comprising a body having a pull tab pivotally connected thereto, said slider body including a top wing and a bottom wing, and means cooperating with said top and bottom wings to define a generally Y-shaped guide channel through said slider body, the combination thereof with a pair of guide members formed respectively by lateral extensions from said bottom wing of said slider body, said lateral extensions being angled upwardly, said cooperating means including a pair of downwardly directed side flanges formed along the respective marginal edges of said top wing of said slider body, said guide members having top edges disposed higher than the bottom edges of said side flanges, said guide members including portions serving respectively as upwardly directed side flanges of said bottom wing of said slider body, said upwardly directed side flanges being also included in said guide members.

* * * * *